US005337693A

United States Patent [19]

Ross et al.

[11] Patent Number: 5,337,693

[45] Date of Patent: Aug. 16, 1994

[54] INTERNAL LINERS FOR OIL TANKERS OR BARGES TO MINIMIZE OIL SPILLS

[76] Inventors: Philip E. Ross, 5175 Lodato Ct., Concord, Calif. 94521; Leonard T. Stanton, 931 Taylor Ave., Alameda, Calif. 94501; Timothy H. Layne, 51 Cityview Way, San Francisco, Calif. 94131

[21] Appl. No.: 947,796

[22] Filed: Sep. 21, 1992

[51] Int. Cl.[5] ..... B63B 43/10

[52] U.S. Cl. ..... 114/69; 114/228

[58] Field of Search ..... 114/227-229, 114/68, 69, 74 R, 74 A, 74 T, 125, 256, 257; 220/404, 461, 900; 405/210

[56] References Cited

U.S. PATENT DOCUMENTS

| | | | |
|---|---|---|---|
| 3,785,321 | 1/1974 | Backstrom | 114/74 R |
| 3,844,239 | 10/1974 | McLaughlin et al. | 114/74 R |
| 3,906,880 | 9/1975 | Hebert | 114/74 R |
| 4,117,796 | 10/1978 | Strain | 114/74 R |
| 4,230,061 | 10/1980 | Roberts | 114/74 A |
| 4,409,919 | 10/1983 | Strain | 114/74 R |
| 4,478,165 | 10/1984 | Strain | 114/74 R |
| 5,003,908 | 4/1991 | Wilson | 114/229 |

FOREIGN PATENT DOCUMENTS

| | | | |
|---|---|---|---|
| 1044549 | 9/1983 | U.S.S.R. | 114/74 T |

OTHER PUBLICATIONS

Kimon et al, Maritime Reporter/Engineering News, Apr. 1973, pp. 12-13.

Tanker Spills:Prevention by Design (National Academy Press, Wash. D.C., 1991), pp. 101-122.

Forum on Alternative Tank Vessel Design, American Petroleum Institute, Jun. 1990.

*Primary Examiner*—Robert J. Oberleitner
*Assistant Examiner*—Clifford T. Bartz
*Attorney, Agent, or Firm*—Patrick D. Kelly

[57] ABSTRACT

This invention relates to flexible internal liners for reducing the amount of oil spilled by oil tankers due to groundings, collisions, and other major accidents. The liner comprises a flexible oil-resistant impermeable plastic or rubber, which preferably is reinforced by steel mesh or woven aramid fibers. In one embodiment, a independent segment is provided in each bay between two stiffeners. The horizontal edges of each liner segment are coupled to the stiffeners, near the ends of the stiffeners, to provide enough material for the liner to be pushed inward a substantial distance if a collision or grounding occurs. The edges can be secured by detachable clamps; this will provide watertight seals during normal operation, while allowing the segment to be detached and opened when the hull is inspected. In an alternate embodiment, a larger curtain segment which covers a number of stiffener bays can be secured in a manner that allows the liner to be pressed against or held near the outer edges of the stiffeners, without being pressed into the bays. In this embodiment, the bay spaces will be filled with water in a coordinated manner as oil is loaded into the tanker, to minimize stresses on the liner and to avoid the need for cleaning the bays. Periodic inspection of the outer hull is accomplished by draining both the cargo and the water layer, and unclamping a section of the liner to allow access inspection of the stiffener bays. Similar liners having a "waterbed" configuration can be provided over the bottom shell. In each of these embodiments, the liner segments can be held in the stand-by position by devices having low tensile strength, which are designed to yield and release the liner if an accident occurs.

8 Claims, 6 Drawing Sheets

INTERNAL LINERS FOR OIL TANKERS OR BARGES TO MINIMIZE OIL SPILLS

BACKGROUND OF THE INVENTION

This invention is in the field of devices for reducing the amount of oil spilled by oil tankers.

There is a constant risk of spillage of crude oil and refined petroleum products (such as diesel oil or fuel oil) by ships, boats, and barges that travel on oceans, rivers, lakes, and bays. The largest such vessels are crude oil tankers, often called "very large crude carriers" (VLCC's), many of which carry hundreds of thousands of tons of crude oil. They pose threats of catastrophic spills due to groundings, collisions, heavy storms, fires, and other accidents, as evidenced by spills involving tankers such as the Exxon Valdez, the Amoco Cadiz, and the Torrey Canyon. However, large tankers do not pose the only risk; numerous types of smaller vessels such as small tankers and barges also pose oil spill risks.

As used herein, terms such as tanker, oil tanker, ship, boat, and vessel refer to any type of tanker, ship, boat, barge, or other water-borne floating tank vessel having a rigid hull, which carries crude oil or refined petroleum product as cargo. It does not refer to ships which carry diesel or fuel oil in fuel tanks solely for generating their own power or propulsion. It also does not include floating bladders (often called dracones) or barges or other vessels that are designed for temporarily holding oil, such as for temporary storage or during an oil spill cleanup.

Oil and petroleum are used interchangeably herein, to refer to either crude oil (unrefined petroleum), or to refined petroleum products which are conventionally stored in non-pressurized tanks, such as diesel fuel, fuel oil, gasoline, or jet fuel. It does not include liquified propane or liquified petroleum gases, which are sometimes transported by tankers having refrigerated pressurized tanks.

Oil tankers have rigid external walls, usually made of steel plates welded together to form water-tight, oil-tight seams. In a VLCC (usually defined as a tanker having a capacity of about 100,000 tons or more), the oil tanks within the main hull are divided into numerous isolated tanks by means of water-tight walls called bulkheads. Tank compartments which are separated by bulkheads are not in direct fluid communication with each other except by means of piping networks, which are controlled by valves and pumps. Although numerous different arrangements are used (see, e.g., P. M. Kimon et al, "Segregated Ballast VLCC's," *Maritime Reporter/Engineering News*, Apr. 1, 1973, pp. 12–13), any VLCC will be divided into multiple segments (usually between five and ten) along the length of the hull, by transverse bulkheads. The compartment at the stern or aft (rear) end of the ship contains the engines; the compartment at the bow (forward) end of the ship, which would be most likely to suffer damage if the ship collides with something, usually contains ballast water. The other segments, between the bow compartment and the engine compartment, are tank compartments which carry oil or ballast water.

Each transverse cargo segment is further divided into three main compartments (two outside compartments along the port and starboard sides, and a center compartment which occupies the middle), by longitudinal bulkheads. For example, a five-by-three arrangement would provide fifteen tank compartments, each of which can be independently filled or drained by pumping systems.

In addition to the structural reinforcement provided by transverse and longitudinal bulkheads, the tank compartments of single-hull VLCC's are also reinforced by two additional types of steel reinforcing members or structures. These are called longitudinal stiffeners, and transverse webs.

Longitudinal stiffeners are relatively short plates (usually about 1.5 meters or less in length) which are welded directly to a wall. These stiffeners typically are welded to four different types of walls. callout number 104 in FIG. 5) reinforce the outermost side wall (usually called the side shell), and bottom stiffeners (shown by callout number 106 in FIG. 5) reinforce the bottom wall (the bottom shell). Those are the only stiffeners of direct interest to this invention, although it should be noted that deck stiffeners are also used to reinforce the upper deck, and internal stiffeners are used to reinforce the longitudinal bulkheads, which separate the center tanks from the outer tanks.

Stiffeners mounted on a vertical wall (a side shell or longitudinal bulkhead) typically have L-shaped cross-sections, where the vertical portion points downward, as shown in FIG. 5. This avoids the creation of trapped pools of oil or ballast water in the "bays" between the stiffeners when the tank is drained. The gap or trough area between two adjacent structural members in a tanker is usually referred to as a "bay." A bay between two identical types of members can be called, for example, a stiffener bay (if it is located between two adjacent stiffeners), or a web bay (between two web members; a web bay is much larger and usually includes a number of stiffener bays).

Bottom stiffeners, which stand vertically, usually have T-shaped, L-shaped, or I-shaped cross-sections. "Limber holes" are usually cut through bottom stiffeners, so that oil or water can flow through the holes and pass from one bay to another as a tank is emptied. This avoids the collection of standing puddles in bottom stiffener bays.

In some tankers, stiffeners are interspersed with longitudinal girders. These are comparable in shape but substantially larger than standard stiffeners. Usually, such girders are affixed only to bottom shells, to provide additional support during drydocking.

VLCC's contain two major types of transverse reinforcing members: (1) transverse bulkheads (discussed above), which provide watertight closures that separate different tank compartments, and (2) transverse webs, which do not provide watertight closures. Webs only provide reinforcement; they typically are made of large plates welded together around the internal periphery of a tank, leaving large openings through the center of the web. Each transverse web spans the entire width of the tank compartment it reinforces. Typically, transverse webs are spaced about three to five meters apart from each other along the keel line of a ship. Several such webs are present in each tank, and they are usually spaced identically in the outer and center tanks, so that they will butt up against each other on opposite sides of each longitudinal bulkhead. This provides additional reinforcement against bending forces in the bulkheads. Each longitudinal stiffener or girder normally spans the entire distance between two transverse reinforcing members; accordingly, a stiffener bay is bounded by two stiffeners (along each side of the bay) and two transverse members (webs or bulkheads, at each end of the bay).

Drawings of stiffeners and transverse webs in VLCC's are shown in various books such as *The Lore of Ships* (Crescent Books, N.Y., 1975) at page 31 and in a pictorial article in the July, 1978 issue of *National Geographic.*

Double-Hulled Tankers and "Equivalents"

The year after the *Exxon Valdez* spill off the coast of Alaska in 1989, the U.S. government adopted a law known as the Oil Pollution Act of 1990 (OPA '90; Public Law 101-380). That law will eventually require all large oil tankers using U.S. waters to have double hulls, or "equivalent" protection, as determined by officials of the U.S. Coast Guard.

In a "double-hulled" tanker, the outer walls of the oil tanks are effectively duplicated by means of a second set of rigid interior walls. The two sets of walls enclose an empty space, usually about two meters wide, which will be filled with non-flammable gas (such as engine exhaust gas) while the tanker is in normal operation carrying oil.

The oil industry objected to the double-hull requirement, for various reasons. For one thing, double-hulled tankers are highly expensive; in essence, they involve building an entire second hull which must be strong enough to withstand enormous loads. It will be very difficult and expensive to retrofit additional hulls inside tankers that are already in service, and it is very difficult to inspect or repair the spaces between the two hulls, which must be heavily girded and reinforced. Double-hulled tankers have spaces where petroleum vapors can accumulate, which can lead to an explosion, as occurred during the SS Puerto Rico sinking, and in some situations, a double-hulled tanker might be more likely to capsize and sink after an accident than a single-hulled tanker. Furthermore, if a tanker suffers a major collision or grounding, having a second hull inside the outer hull is unlikely to make a major difference in the amount of oil that spills out of the tanker; because of the enormous mass, weight, and momentum involved whenever a supertanker moves, a rock or reef that can cut through one steel plate will probably cut through two adjacent steel plates just as easily. In addition, if a double-hulled tanker suffers a major accident and presents a danger of sinking, the large number of additional spaces where oil can be trapped makes it more difficult to remove the oil either before or after the tanker sinks, and can cause the sunken tanker to continue leaking oil for years, as evidenced by the continuing oil leakage from the double-hulled SS Puerto Rico off the northern California coast, which sank years ago.

Despite those objections by the oil and tanker industries, Congress and most of the American public believes that more needs to be done by the oil and maritime industries to reduce the risk and the frequency of offshore oil spills, and to reduce the quantity of oil spilled during the accidents that inevitably occur. That belief is compounded by the fact that prior to the Exxon Valdez spill, the oil industry reassured Congress and the public that effective oil spill containment and cleanup measures were ready and waiting and would greatly limit any damage if any spills occurred; however, when the Valdez spill occurred, those assurances were shown to be unreliable.

Clearly, the law passed by Congress reflects dissatisfaction with the promises and solutions that have been offered so far by the oil industry and the tanker industry. Nevertheless, the law specifically provided that if any "equivalent" methods of protection could be developed, then the maritime experts in the U.S.. Coast Guard can approve such equivalents. There is, therefore, a need for alternative devices for oil tankers, which can provide a comparable degree of safety but which can also avoid the drawbacks and dangers of double-hulled tankers.

Additional information on oil spills and tanker design is available in works such as the book-length report entitled *Tanker Spills: Prevention by Design*, issued in February, 1991 by the National Research Council (Washington, D.C.), and in various publications issued by the International Maritime Organization (IMO). Two IMO reports which are relevant are the proceedings of the 1973 International Conference on Marine Pollution, which contained a set of regulations known as the MARPOL '73 standards, and the "Protocol of 1978 Relating to the International Convention for the Prevention of Pollution from Ships," known as the Protocol '78 regulations. These requirements relate primarily to segregated ballast requirements; prior to their adoption, ships discharging ballast water from oily tanks would leave sheens that stretched for miles. Accordingly, so-called "MARPOL tankers" (i.e., tankers which adhere to the MARPOL standards) are required to have separate tanks for ballast water, which are never filled with oil except in an emergency.

In addition, a collection of papers on this subject is available from the American Petroleum Institute (API). This collection grew out of a "Forum on Alternative Tank Vessel Design" which was sponsored by the Transportation Division of the API on Jun. 5, 1990. Although it is not clear whether that collection should be regarded as a "publication" under the patent law, the Forum was open to the press and public, and the collected papers (unbound) can be obtained for $25.00 from the API (Washington, D.C.).

Flexible Barriers in the Prior Art

In the search for alternate methods of reducing offshore oil spills, a number of inventors have proposed the use of flexible sheets of rubber or plastic inside tanker hulls. To the best of the Applicants' knowledge, none of those proposed systems are in actual use in any tankers; nevertheless, a study of what has been suggested in the past can be interesting and instructive.

Nothing that is said below is meant to be derogatory or demeaning toward the prior art. These comments are intended instead as a candid and realistic appraisal of the problems that are encountered when this type of approach is attempted.

An early suggestion for using a flexible rubber membrane as a lining inside a ship hull, to keep the ship from sinking after a collision, is described in U.S. Pat. No. 326,896 (Bridge 1885). Although it had no clear information on how the rubber layer could be held in place inside the hull without causing it to rip apart when challenged, that patent anticipated the general idea of using a rubber membrane inside a ship hull.

Another early suggestion, in U.S. Pat. No. 659,948 (Wysgalla and Engel, 1900), proposed the use of pleated metal sheets, folded in layers comparable to a hanging curtain and then pressed against the inside of the hull. In this manner, excess metal would be available which could be pulled and stretched for a substantial distance inside the hull, without tearing, in the event of a collision.

Although that idea may have had some merit, during the decades that followed, most efforts to prevent ships from sinking (which included a great deal of effort involving military ships) focused instead on using reinforced bulkheads to preserve air-tight compartments that could be closed off to keep a badly damaged ship afloat so the crew and any passengers (or soldiers or sailors, on military vessels) could be rescued even if a large part of the hull was badly ruptured.

Not long after the massive Torrey canyon oil spill in 1967, a surge of interest reappeared in using flexible membranes in oil tankers. This led to various proposals such as U.S. Pat. No. 3,785,321 (Backstrom 1974), which suggested that a vertical barrier, such as a layer of rubber held in place by vertical steel ribs, could be used to create a separate storage area adjacent to the outer hull, which could be filled with water rather than oil.

This proposal suffered from several limitations. In the primary suggested mode of operation, a substantial portion of the cargo would have been displaced by water. If a second proposed method of use were adopted in which oil filled the space between the barrier and the hull, it would become impossible to use conventional tank cleaning techniques to clean that space each time the tank is emptied. In addition, that proposed system does not appear to adequately take into account the need to periodically inspect the spaces between the barrier and the hull, stresses that might be imposed on the barrier if the ship encountered heavy seas, or the problems of loading both oil and water into the tanks in direct contact with each other. In addition, since the vinyl layer is prevented from moving by the frame ribs which hold it in place, it could not flex and yield during a collision or grounding; therefore, it would be likely to be torn and cut in the same manner that rigid steel plates are torn during such accidents.

U.S. Pat. No. 3,844,239 (McLaughlin et al 1974) suggested that a rubber bladder could be fitted inside each tank in a tanker, either by fitting a bladder-type bag inside the tank, or by spraying a layer of an elastomer directly onto the inner walls of the hull. The proposed goal was as follows: if the tank is, in effect, squeezed during a collision, the bladder (if it remains intact and watertight) would squeeze the oil upward and into a large pipe, through a membrane barrier which would be designed to rupture and open if the pressure in the pipe suddenly increased as a result of a collision. That pipe would carry the oil to another tank, which would be kept waiting and empty on a standby basis during normal operations in order to provide excess storage capacity that would be used in the event of a collision.

This proposal also suffered from several limitations. Most collisions involving tanker hulls generate jagged steel edges which act as sharp blades as the torn edges of the hull enter the tank. These jagged edges are likely to simply rip open any flexible layer which is being pressed against the outer hull by the weight of the oil. In addition, the complex arrangement of the internal stiffeners (which are usually L-shaped along the side walls and I-shaped or T-shaped along the bottom) would render it virtually impossible for any layer of sprayed-on material to disengage itself from the inside of the hull in the manner suggested in the patent.

U.S. Pat. No. 3,906,880 (Hebert 1975) proposed a system using a flexible layer of vinyl which, during normal operations, would be held suspended beneath the deck inside each tank. If a tank were ruptured, the vinyl layer would be released so that it would drop into the oil. A special pumping system would then be used to pump oil out of the ruptured tank and into the bladder, and the bladder would begin expanding to fill the tank as it received more oil. As the pumping operation proceeded, the oil would stay inside the same tank compartment, but it would move from outside the bladder, to inside the bladder. This patent asserted that a wire mesh barrier, which would also be carried inside the tank suspended beneath the deck, could also be dropped into the tank in the event of a collision and would protect and prevent the vinyl sheet from being ripped by the jagged steel edges formed by the torn hull.

This proposal suffers from the problem that it is not a good idea to hang anything from the underside of a deck inside a tank, for at least three reasons. First, if the tanker encounters heavy seas, anything suspended from the bottom of a deck, inside a tank, can be subjected to severe pounding forces from the oil. Second, modern tankers use special cleaning jets which spray hot oil inside the tank during cleaning, which normally occurs every time the oil is unloaded. Anything suspended in the tank beneath the bottom of the deck would interfere with that operation. And third, the problem of paraffin accumulation (i.e., build-up of hard waxy material that coats and clogs any surfaces it contacts) renders it generally unwise to try to install complicated equipment which is intended to be moved inside an oil tank, unless such equipment also provides some way to heat the system and melt the paraffin.

U.S. Pat. No. 4,230,061 (Roberts and Kohn 1980) proposes that a flexible bladder can be inserted into the tank of a tanker and then filled with oil. This patent does not display any awareness of transverse webs or longitudinal stiffeners inside the tanks; it also appears to assume that air will remain in the layer between the bladder and the hull, which implies that the material must be strong enough (and heavy enough) to withstand the entire weight of the oil loaded into the tank. Despite those assumptions, the patent asserts that the bladder can be conveniently lowered into the tank and easily fitted into position, and that if the bladder is ripped or damaged, it can be removed and repaired "with no greater difficulty than when fixing a flat tire on a car." In another curious comment, the patent asserts that the bladder, when full, can be sealed by "a conventional stopper" which, in the drawings, looks and functions like a cork shoved into the neck of a jug. One might imagine what it would be like to use giant corks to seal up the holds of VLCC's; however, the idea would seem rather peculiar to anyone who has ever stood on the deck of a VLCC. The bladder would also render it impossible to use the filling and drainage systems that are in actual use in oil tankers, yet U.S. Pat. No. 4,230,061 makes no effort to describe an alternative system, or to overcome the problems that would arise if suction were used to pump crude oil, which has a high vapor pressure.

U.S. Pat. No. 5,003,908 (Wilson 1991) proposes a system which would use deployable curtains that are pulled into place, when needed, over the outside of the hull (i.e., exposed to the ocean). Rolled curtains would be stored either on deck, or in special comparments mounted along the bottom of the tanker near the keel. The leading edge of the curtians would be attached to cable that would be pulled, when needed, by winches mounted on the deck.

This approach raises a number of questions. For example, if the rollers containing the rolled-up curtain are mounted along the underside of the tanker, they would be likely to be damaged or jammed and rendered inoperable during a grounding accident. Also, it is not clear how the keel region with the added compartments would be designed in view of the very large structural forces on the internal bulkhead and outer shell components that intersect at the keel. For structural reasons, designers and builders of tankers are very reluctant to place long openings through the outer shell. If the curtain rolls are mounted on the deck, it is not clear how the cables would pass upward; apparently, they would need to pass through some sort of pathway going upward through the tanker, next to a longitudinal bulkhead. Furthermore, regardless of where the curtain rolls are located when not deployed, the following factors would limit their utility: (1) they cannot be deployed until after an accident occurs, or they would be torn by the same intruding object that breaches the hull; (2) they cannot be deployed until after the intruding object is removed and no longer stands in their path (for example, if a tanker suffers a grounding accident, it must be pulled off the rocks or reef before the curtain can be deployed; during that time, oil will be escaping); and, (3) emergency conditions such as a fire or heavy seas could render deployment extremely difficult or impossible.

U.S. Pat. No. 4,953,491 (Zaitoun 1990) describes a system of rails which are mounted on the outside of a tanker. A wheeled cart-type device, with movable flaps around its periphery that press against the outer hull, is designed to travel along the rails until the cart reaches and covers a hole in the side of the tanker. A major limitation is readily apparent in this approach: the rails are very likely to be bent during any serious accident, rendering the cart device unable to reach and cover the hole.

Three relevant proposals were contained in the American Petroleum Institute's collection of papers presented at the June, 1990 Forum on Alternative Tank Vessel Design. The relevant papers are cited herein as Watson and Duhe 1990, Hornfelt 1990, and Gallagher 1990.

Watson and Duhe provide information on materials made by DuPont which could be used as components in liners, and they recommend a fiber reinforcement layer embedded in an elastomeric resin. Candidate reinforcing fibers included Kevlar TM (an aramid fiber which is roughly five times stronger than steel on an equal-weight basis), woven polyester fibers, and woven nylon fibers having a molecular configuration with varying resistance to crude oil, kerosene, and gasoline included Hytrel TM thermoplastic co-polyester, Elvaloy TM-/polyvinylchloride, and Hypalon TM chlorosulfonated polyethylene. Information on the chemical components and performance parameters of those materials is available from DuPont (Wilmington, Del.). The Watson and Duhe paper did not provide detailed information on how such a liner should be installed, and the two drawings were highly simplified. This paper was, in essence, a recommendation by a chemical company that flexible liners should be considered, since synthetic materials with high strength and good resistance to tearing and degradation are available.

Hornfelt 1990 describes a three-layer system. The outermost layer is the steel layer of the hull; a layer of flexible foam is placed next to it, and an impermeable layer which forms a bladder is placed next to the foam. This proposal does not appear to take into account the various internal structures inside a tank, such as stiffeners and webs, or the piping and drainage systems used in tankers. Except for the additional layer of foam between the bladder and the steel, it resembles other items such as U.S. Pat. No. 4,230,061 (Roberts et al 1980, discussed above), and suffers from similar limitations.

Gallagher 1990 describes an elastomeric bag which sits in the bottom of a tank, filled to a depth of (apparently) several meters with ballast water. The side walls of the bag are attached to the outer shell and longitudinal bulkhead a substantial distance above the bottom of the tank, so that the entire bag can be lifted upward in the event of a grounding. The Gallagher system is one of the more interesting proposals; with some development work (possibly including modification as described herein), it might prevent or substantially reduce oil spillage due to grounding accidents. It also suggests a way to satisfy the MARPOL requirements for segregating ballast water, without requiring dedicated tanks. If ballast water were to be stored inside flexible bags with clean interiors, resting on the bottom hulls of tankers, the bags could be emptied when crude oil is loaded into the tanker, and the currently segregated ballast tanks could be used for carrying crude oil; this would increase the total cargo capacity of the tanker.

Despite those potential advantages, the system described in Gallagher 1990 does not appear to be effective in protecting against collision-type damage, which usually occurs at or near the water line (as compared to grounding damage, which usually damages the bottom hull). In addition, Gallagher 1990 indicates that the bottom layer of the bag should rest deep inside each bay between two adjacent longitudinal stiffeners, against the bottom shell. This raises serious questions as to whether the bottom layer would be torn open as the outer shell and stiffeners are torn and bent during a grounding accident, and the ability of the bag to remain watertight after a grounding accident is doubtful. Each square meter of material resting in a bay will have many tons of weight resting on top of it, which would prevent it from sliding quickly or easily across the surfaces of the various steel plates in order to provide the surplus material which would be needed to avoid tearing during a collision.

In summary, all of the devices which have been proposed to date for using flexible liners or movable devices to limit oil spills suffer from various design or operating limitations. To the best of the Applicants' knowledge, none are in actual use or active development, and the 1991 report of the National Research Council concluded that, "the committee could find no evidence that this concept has been utilized successfully in a cargo tank. Its total absence in the tank vessel industry likely is due to practical obstacles, which have been insurmountable so far" (page 121).

Current Plans re: Selling Aging Tankers Overseas

Based on discussions with various people in the industry, and in view of certain provisions in the Oil Pollution Act of 1990, it appears that American oil companies may be planning to require double-hulled tankers for all new tankers that they purchase, but they currently have no intention of retrofitting flexible liners or other comparable safety devices onto existing tankers. Instead, they apparently plan to sell any old tankers that cannot meet U.S. requirements to operators who will agree not to use them in U.S. waters. The double-hull requirements will apply to old tankers when they reach the age of 20 years. By no mere coincidence, this just happens to be the depreciation life of tankers under U.S. tax laws. Accordingly, as soon as a tanker has been fully depreciated under the U.S. tax laws, it will be sold to some company that will be contractually obligated to keep it out of U.S. waters.

This strategy would seem to have a number of risks. For one thing, it is highly likely that at least some of the corporations that will be created to own and operate aging tankers will be created and intended to operate only as long as they make a profit. The assets of such companies will be kept deliberately low, and usually will consist only of the tankers themselves; it is, indeed, entirely possible and legal to set up a sepearate corporation for each and every tanker. If a major oil spill occurs, such corporations will simply declare bankruptcy and cease to exist, in an effort to shield the owners from any liability and shift the burden to someone else to pay for the cleanup and damage.

A major legal risk for major U.S. and multinational oil companies is that if the coast of another nation has been severely damaged and fouled by massive oil spills, the governments and the courts of that nations will do everything possible to "pierce the corporate veil" and hold the seller of an aging tanker liable for cleanup costs caused by the tanker. Such nations and their courts will use every tactic they can, under their own laws rather than under the laws of the United States, to reach beyond any private contracts written by oil company lawyers and demand repayment from the multinational oil companies, especially if the primary purpose of any such contract to sell an aging tanker was to try to circumvent and evade any liability or responsibility for damage done by the tanker. Since multinational oil companies are regarded as having "deep pockets," if a multinational oil company sells an aging tanker to some other company which creates a disaster and then declares bankruptcy, then the multinational company will quickly become the primary litigation target of foreign courts, foreign lawyers, and foreign nations. Even though tax lawyers and lobbyists may have suggested to multinational oil companies that a cheap and easy way is available to get around the new U.S. law, it seems likely that in view of the risk of multi-billion dollar liabilities at the hands of foreign courts, the multinational companies that operate VLCC's will eventually realize that they need to take a long, hard look at safety devices that can be retrofitted onto existing VLCC's, which can provide an effective equivalent of (or even an improvement over) double-hull protection.

Accordingly, there remains a need for a non-rigid device or system which can be retrofitted to existing tankers, using an approach that can overcome the "practical obstacles" mentioned in the National Research Council's 1991 report. In addition, there remains a need for a feasible and effective alternative to rigid double hulls in newly-built tankers.

One object of the subject invention is to provide a practical and effective flexible membrane for providing backup containment safety in oil tankers to reduce the amount of oil that will be spilled if an oil tanker suffers a grounding or collision, which adequately takes into account the internal design and the operating, cleaning, and inspection requirements of oil tankers.

Another object of this invention is to provide a backup containment system that can be retrofitted into existing tankers at substantially less expense than the cost of retrofitting a second hull inside or outside the tankers.

Another object of this invention is to provide a backup containment system that is easier to inspect and repair than a double-hulled tanker.

Another object of this invention is to provide the oil and tanker industries, and the federal government, with a reasonable, effective, and acceptable alternative to double-hulled tankers.

SUMMARY OF THE INVENTION

This invention relates to flexible internal liners for reducing the amount of oil spilled by oil tankers due to groundings, collisions, and other major accidents. The liner comprises a flexible oil-resistant impermeable plastic or rubber, which preferably is reinforced by steel mesh or woven aramid fibers. In one embodiment, a independent segment is provided in each bay between two stiffeners. The horizontal edges of each liner segment are coupled to the stiffeners, near the ends of the stiffeners, to provide enough material for the liner to be pushed inward if a collision or grounding occurs. The edges can be secured by detachable clamps; this will provide watertight seals during normal operation, while allowing the segment to be detached and opened when the hull is inspected. In an alternate embodiment, a larger curtain segment which covers a number of stiffener bays can be secured to the deck in a manner that allows the liner to be pressed against or held near the outer edges of the stiffeners, without being pressed into the bays. In this embodiment, the bay spaces will be filled with water in a coordinated manner as oil is loaded into the tanker, to minimize stresses on the liner and to avoid the need for cleaning the bays. Periodic inspection of the outer hull is accomplished by draining both the cargo and the water layer, and unclamping a section of the liner to allow access inspection of the stiffener bays. Similar liners having a "waterbed" configuration can be provided over the bottom shell.

DESCRIPTION OF THE PREFERRED EMBODIMENTS

This invention relates to a flexible liner system for reducing the amount of crude oil or refined petroleum spilled by an oil tanker, barge, or other floating tank vessel after an accident which breaches the outer hull, such as a collision or grounding. This system involves liner segments that are installed within individual stiffener bays, or overlaying a contiguous set of stiffener bays, in a watertight but detachable manner. This arrangement accomplishes several objectives:

(1) it creates a watertight zone between the outer hull and the liner segment, so that oil does not reach or contact the outer hull surface which is covered by that liner segment. This protects the inner surface of the outer shell and eliminates the need for regular cleaning of the hull surface; during cleaning operations, the liner surface is cleaned instead of the hull surface.

(2) it allows the liner segment to be pushed inwardly into a tank compartment area if the outer hull is breached, without breach of the liner segment;

(3) it allows each liner segment to be temporarily detached, to allow periodic visual inspection of the outer hull.

An important aspect of the liner installations disclosed herein is that, if an accident occurs, these liner installations can be pushed inwardly, into a cargo tank, without requiring any substantial sliding of a liner surface across a steel structural surface. This is in direct contrast to most of the liner systems proposed in the prior art, since those liner systems would require portions of the liner to slide across various steel surfaces (such as the sides of stiffeners). That requirement is infeasible, since tons of pressure per square foot are imposed on the liners by the weight of the oil in the cargo tanks. Accordingly, one of the constraints of the liners disclosed herein is that they should avoid or minimize any requirement of dragging or sliding liner material across steel surfaces if an accident occurs and the liner is pushed inwardly into a tank.

Preferred liner materials will be discussed below, followed by preferred configurations for installing such liners.

Preferred Liner Materials

Figure 1:
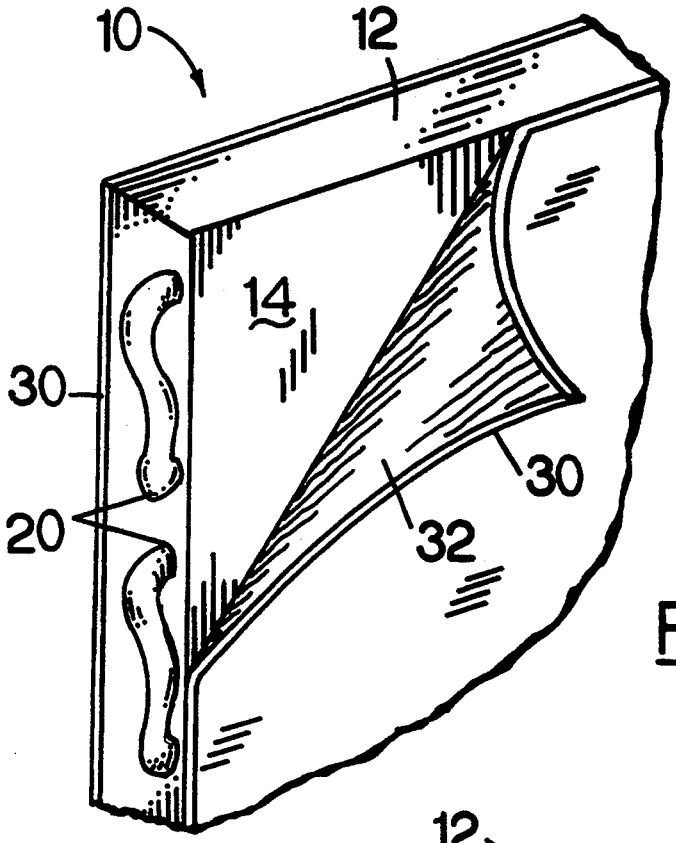
FIG. 1 depicts a multiple-layered flexible material of this invention, showing a center layer of interlocking steel links impregnated with a rubber or flexible plastic, covered on each side with a bonded layer of vinyl, urethane, rubber, or other suitable material, reinforced by a strong fibrous material such as a nylon mesh.

Referring to the drawings by reference numbers, number 10 in FIG. 1 refers to a segment of reinforced impermeable material which can serve as liner material as described herein. Center layer 12 is made of an elastomeric material 14 such as a rubber or plastic, which contains embedded steel links 20 (shown in FIGS. 1 and 2), steel coils (as shown in FIG. 3), or synthetic fibers (shown in FIG. 4) for reinforcement. If desired, one or both of the flat surfaces of the impermeable center layer 12 can be covered with an outer layer 30, as described below.

Figure 2:
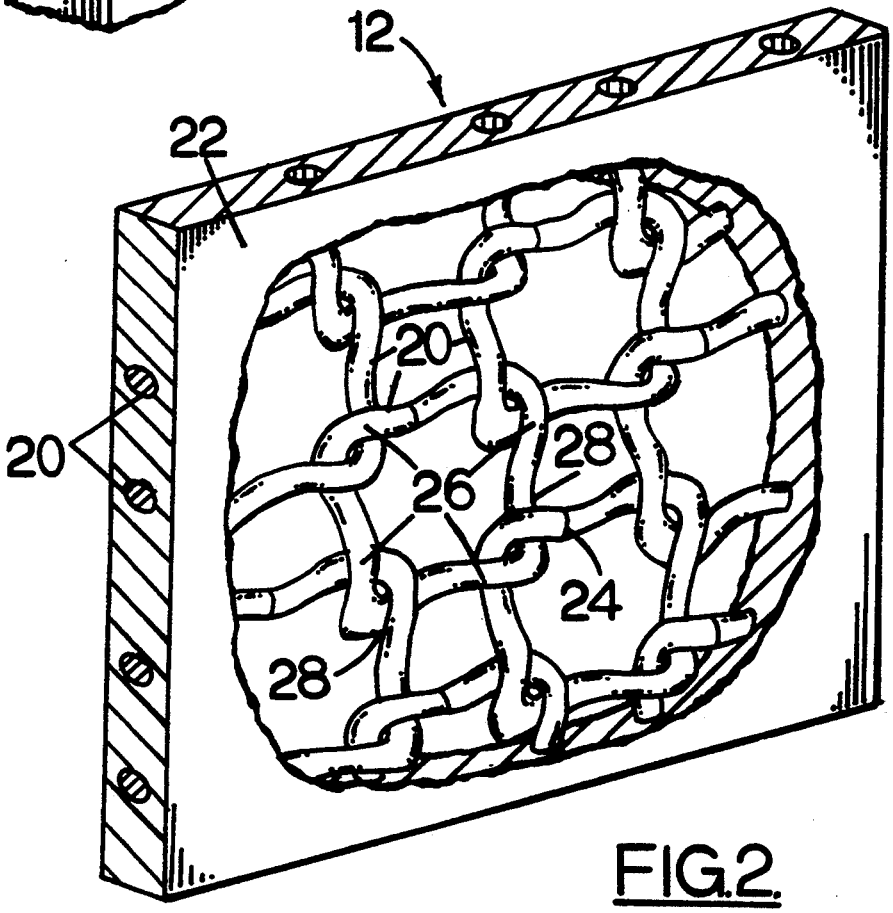
FIG. 2 depicts an impermeable liner material containing an embedded reinforcing layer of steel links.
Figure 3:
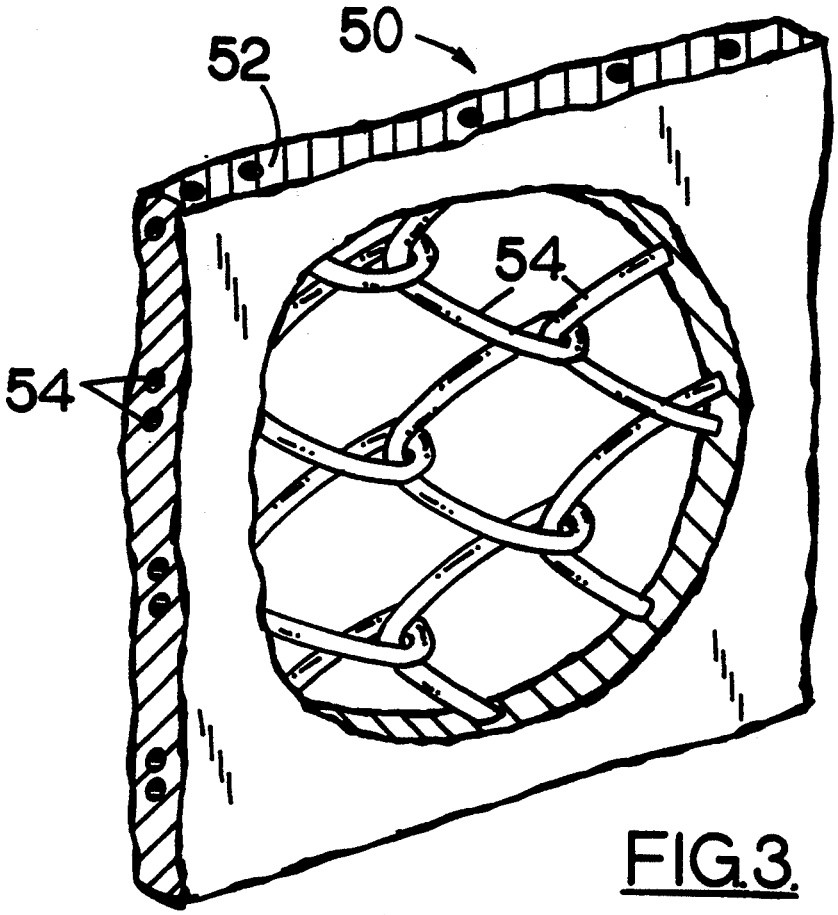
FIG. 3 depicts an impermeable liner material containing a reinforcing layer of helical coils comparable to a chain link fence.

In FIGS. 1 and 2, interior layer 12 is reinforced by links 20 made of steel or some other suitable metal. If desired, the links may be made of or coated with an alloy or coating which suppresses spark formation. The links 20 are interlocked with each other to form a mesh 22 as shown in FIG. 2. Such meshes can be created in any of several ways known to those skilled in the art of making steel meshes, such as by forging links with gaps, assembling the links in a mesh configuration on a large flat surface while the links are hot and malleable, pressing the two ends of each link together until they abut each other, and welding together the two ends of each link to form a welded seam 24. Alternately, half the links can be forged as complete links, which are laid out on a flat surface. The other links are created in halves as joining links, which are pieced together and then welded at two locations on each joining link.

As indicated in FIG. 2, the links 20 are not entirely planar. The corner segments of at least some of the links 20 must be offset somewhat in order to allow the links to fit together in an overall configuration which is roughly planar. FIG. 2 shows a link 20 having four corner regions 26 which are offset in front of the primary plane of the link 20, while corner regions 28 are offset behind the primary plane.

Although the thickness and strength of the center layer 12 can vary and will depend on the size of the tanker it will be used in, it should be noted that even in VLCC's having capacities of 250,000 tons the thickest steel plates used in the hulls reportedly are less than about 5 cm (2 inches) thick. When a tanker is fully loaded, the pressure differential (inside vs. outside) at any given point in the hull normally does not exceed about 5 pounds per square inch (about 250 tort, or $\frac{1}{3}$ atmosphere). Although pressure differentials are higher when the tanker is empty (the bottom of an empty tanker loaded with ballast water may be submerged 20 feet or more), the flexible membranes described herein do not need to be able to withstand those higher pressure differentials.

Accordingly, links 20 are anticipated to be made of cast or forged steel roughly 1 to 3 centimeters (about 0.4 to 1 inches) thick when measured as a cross-section through a specific portion of the link. Each link 20 will have overall dimensions of about 5 to 25 cm (2 to 10 inches) in width and height. Since the links 20 are not entirely flat or planar, the overall thickness of the mesh will be about 1.5 to 2 times the cross-sectional thickness of the steel in each link. If desired, an assembled section of mesh can be passed through a rolling mill to flatten it to a desired dimension.

The impermeable rubber or plastic material 14 is formed after the steel mesh 22 has been completely assembled. This can be done by means such as laying the mesh 22 or coils 32 inside a tray, pouring a liquified mixture containing suitable reagents over the mesh, and curing the liquid reagents by heat treatment to harden it into elastomer 14. The impermeable flexible material 14 can be any desired thickness, such as about 1.2 to 2 times the overall thickness of steel mesh 22

As shown in FIG. 1, one or both of the flat surfaces of the impermeable center layer 12 can be covered by an outer layer 30. This can allow for certain advantages such as the use of an elastomeric material 14 which is less expensive and less resistant to degradation by oil than might otherwise be required. It also allows the use of inexpensive smooth-surfaced outer layers 30 with low friction characteristics; these can withstand chafing better than most elastomers, which tend to grip and cling to solid surfaces and which therefore are more prone to wear and damage due to chafing, which will occur during loading and unloading and in heavy seas. In addition, such outer layers 30 can be periodically covered or replaced without requiring replacement of the entire liner; this may be economically preferable if the center layer 12 uses high-cost materials such as aramid fibers for reinforcement.

If desired, outer layer(s) 30 can be reinforced by means of woven or knitted fibers, such as a nylon mesh 32. Mesh 32 is shown for illustrative purposes on the inner surface of outer layer 30; normally, the reinforcing mesh 32 will be embedded within outer layer 30. For purposes of illustration, outer layer 30 is show with one corner peeled away from center layer 12; normally, outer layer 30 should be securely bonded to the center layer 12.

Various alternate configurations can be used for reinforcing the interior impermeable elastomeric layer. For example, impermeable layer 50 shown in FIG. 3 contains an elastomeric material 52 and reinforcing coils 52 having the general configuration of a chain-link or "hurricane" fence as reinforcement. Coils 52 should be made of a relatively bendable steel, and the elastomeric material 54 should be able to stretch substantially without breaking (such as at least 150 percent, or preferably at least 200 percent on a linear basis). If made in this manner, liner segment 50 could be stretched a substantial distance, which would reduce tearing during an accident.

Figure 4:
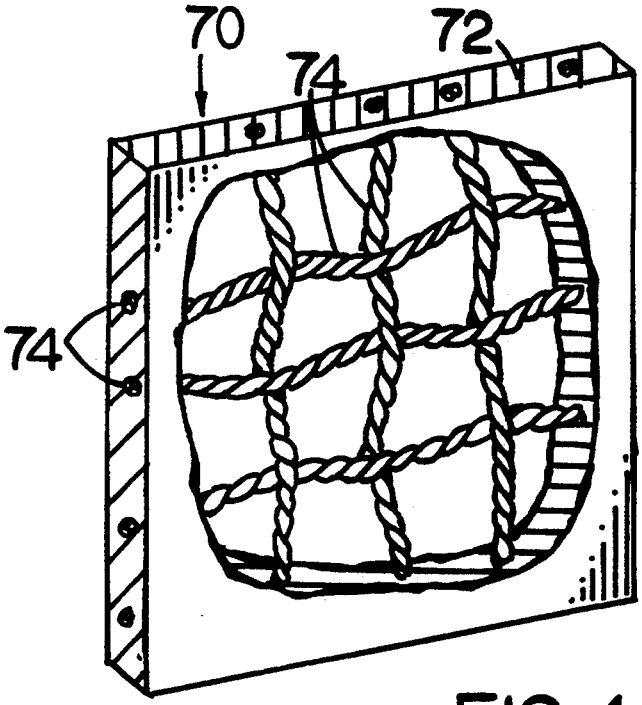
FIG. 4 depicts an impermeable elastomeric layer reinforced by woven fibers such as aramid or nylon.

Another alternate interior layer 70 shown in FIG. 4 contains an impermeable material 72 which is reinforced by a fibrous material such as aramid, polyester, or nylon. The fibers are formed into clustered strands 74 resembling rope or yarn (often called "industrial yarn") which is woven into a sheet of material using either a conventional weave (as shown in FIG. 4) or a basket configuration (having diagonal strands as well). The preferred thickness of the yarn and the type and density of the weave will depend on the size of the tanker and the desired strength and safety factors. On an equal-weight basis, aramid yarn has about 5 times the tensile strength of steel, and aramid fabrics are used in devices such as bulletproof vests. Specifications for various weights of Kevlar TM fabric are provided in Watson and Duhe 1990.

If steel links 22 or steel coils 32 are used to reinforce a liner segment, the links or coils will provide attachment points which will allow the entire liner segment (including any outer layers 30) to be securely affixed inside a tank by any suitable means, such as bolts, hooks, cables, or chains. If woven fibers 40 are used for reinforcement, any of several techniques can be uses. For example, holes can be cut or punched through the liner material, and grommets can be affixed in the holes to provide reinforced attachment points. Alternately, extra-thick strands of yarn can be woven in the layer at spaced locations(such as every few inches), in a manner analogous to the so-called "rip-stop" nylon fabric used in items such as tents and tarpaulins; the extra-thick strands will serve as attachment points. In either situation, the elastomeric material can be cut to expose the reinforcing links or strands, and the attachment device can be looped around or otherwise coupled to the strand. When this is completed, the cut can be sealed using an elastomeric sealant such as silicone rubber adhesive, which will cure to form a watertight and oil-tight bond around the attachment device.

The selection of the elastomeric material which is preferable for use in a specific tanker or barge will require attention, since crude oil often contains sulfur, salt water, and other reactive or oxidative contaminants, as well as low molecular weight organic fractions that can act as solvents; all of these can weaken some types of rubber or plastic. In general, any material used as described herein should be substantially resistant to degradation by crude oil or refined petroleum products. Various synthetic polymers in use today in devices which handle crude oil or refined products include polyesters, polyvinylchlorides, chlorosulfonated polyethylenes, and fluorinated polymers. Detailed information on grades and durability of elastomers, polymers, and steel are available from manufacturers, and from organizations such as the American Society of Testing and Materials (ASTM).

Among both polymers and metals, there is a wide range of durability and resistance to corrosion. For example, many relatively inexpensive rubbers or plastics can withstand a year of service in regular contact with crude oil, while more expensive materials can withstand twenty years or more. Similarly, low-grade steel is not very resistant to rusting or corrosion, while higher grades such as chromium-containing (stainless) steel are much more durable and resistant. In any such situation, a wide range of candidate materials are available, as is well-known to those skilled in the art; however, the costs increase substantially if premium materials which are more durable are selected.

Accordingly, the optimal choice of materials for use as described herein is largely a matter of economics, which will depend on the particular tanker, barge, or other ship which is being equipped or retrofitted with flexible liner material as described herein. Those skilled in the art can select economically preferred or government-mandated materials to satisfy any combination of objectives for a specific use, based on factors such as the anticipated remaining lifetime of a vessel or planned replacement intervals for liner components, or to meet industry codes or government requirements.

Suitable elastomeric materials can be either thermosetting (i.e., they can be shaped once when heated to a melting temperature, but they cannot be subsequently reheated and shaped again) or thermoplastic (i.e., they can be melted and reshaped repeatedly), so long as they do not suffer a major reduction in strength at the temperatures encountered when crude oil is loaded onto the tanker. In many oil fields, the oil is somewhat hot as it emerges from the wells, and it is often heated during separation processing. However, it usually does not exceed about 70° C., which is well below the melting points of most industrial-grade thermosetting or thermoplastic polymers.

Independent Segments in Stiffener Bays

A liner segment 10 made of material such as described above can be installed in the tank compartments of a VLCC, adjacent to the outer hull, in any of several preferred configurations. In one preferred embodiment 100, shown in FIG. 5 and FIG. 6, a liner segment 10 is installed in the bay region 102 between two adjacent stiffeners 104 and 106. The stiffeners 104 and 106 are welded to the interior surface of outer hull 108 (which is also referred to as side shell 108).

In embodiment 100, a series of liner segments 10A, 10B, and 10C are installed in a set of contiguous stiffener bays 102. The following steps depict the installation of segment 10B in the center bay shown in the figure, which preferably is done after the lower portion of segment 10A has already been installed using the same steps outlined herein.

Figure 6:
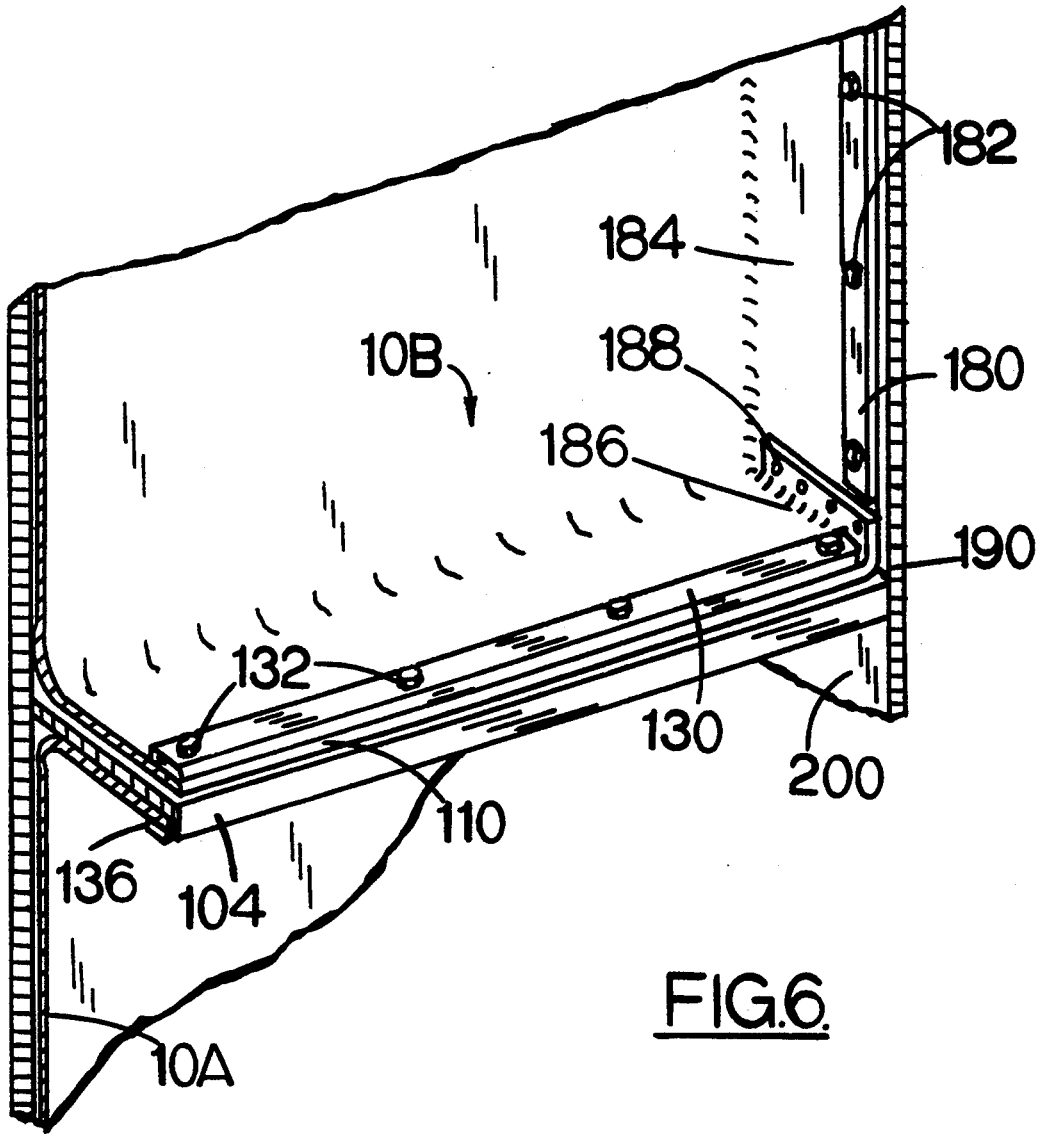
FIG. 6 is a cutaway perspective view of a liner segment in a bay between two longitudinal stiffeners, showing the length of the bars used to create the watertight seals and the attachment to a transverse web.

The lower edge 110 of liner segment 10B is laid on top of stiffener 104, which has a set of holes 122 cut or drilled through it. These holes are spaced apart from each other by a suitable distance, such as roughly 1 to 2 meters (3 to 6 feet), along the length of the stiffener 104 as shown in FIG. 6. Stiffener 104 and liner segment 10 span the distance between a transverse web 124 and an adjacent web or bulkhead (not shown in the cutaway drawing in FIG. 6). If holes have not previously been cut through the liner segment 10, they are cut or drilled when the liner is positioned on top of the stiffener 104. The liner holes must be aligned with the holes 122 which have been cut or drilled through the stiffener.

A rigid bar 130 which also has holes cut or drilled through it is placed on top of the liner segment 10 in a manner which aligns the holes. Bolts 132 are inserted through the holes 122 so that the threaded lower ends 134 of bolts 132 project down below stiffener 104. To prevent rotation of a bolt 132 when the nut 138 is being removed or tightened, the head of bolt 132 can be tack-welded to bar 130; alternately or additionally, the necks of bolts 132 and the holes through bar 130 can have square or other non-circular shapes, as used in so-called carriage bolts. Alternately, instead of threaded bolts and nuts, various types of mechanical clamps can be used to secure the clamping bar in position and press it against the liner with sufficient force to generate a watertight seal.

If liner segment 10A is being installed in the lower adjacent bay, the upper end 112 of liner segment 10A is lifted into position and held in position, using elongated C-clamps to temporarily clamp and hold the lower liner in position if desired. Another rigid bar 136 with properly spaced holes is placed in position as shown, pressing in an upward direction against liner segment 10A. It is tightened down by means of nuts 138, which can be (1) standard hex nuts, which can be tightened or removed quickly using a hand-held air-driven wrench; (2) square-headed nuts, which can also be tightened or removed using an air wrench and which might be easier to grip than hex nuts if paraffin buildup is a problem; (3) wing nuts (which are shown for illustrative purposes), which can be tightened or removed either by hand or with a rubber mallet.

When nuts 138 are tightened on the ends of bolts 132, the squeezing action that is exerted on the bars 130 and 136 will clamp the bars tightly against the liners 10A and 10B. The multiple nuts which are spaced along the length of the stiffener 104 and bars 130 and 136 are tightened sufficiently to create watertight seals between each liner layer and the upper and lower surfaces of stiffener 104.

If desired, liner segment 10B can be partially held in position resting on the upper surface of stiffener 104 by means of a spaced series of loops 150, each of which is coupled to one of the reinforcing links or strands 152 embedded in the liner segment 10B. Each loop 150 is placed over a hooking device 154, which has been welded to the upper surface of stiffener 104 and which preferably should have rounded surfaces with no sharp edges exposed to the liner segment 10B. Loop 150 should be made of a material having a relatively low tensile strength, comparable to a fairly heavy fishing line. These loops are designed to break and release the liner from the hooking devices 154 if an accident such as a grounding or collision occurs and pushes the liner segment 10B inward. During installation of a liner segment, loops 150 can be secured over hooks 154 either before or after the lower edge 110 of the liner segment 10B are secured in place by means of the bar and bolt assembly. If desired, loops 150 can be replaced by more complex attachment devices which provide secure closure with no possibility of slippage, such as the spring-gated hook 160 discussed in the next paragraph.

After the lower region of the liner segment 10B has been installed and is resting securely on the upper surface of stiffener 104, the upper portion is installed, first, by coupling a supporting device such as hook 160 to an eyelet 162 which has been welded to the underside of stiffener 106. Hook 160 can be equipped with a secure closure device such as a spring-mounted gate 164. The lower end of hook 160 is coupled, either directly or indirectly, to one of the reinforcing links or strands 166 which are embedded in liner segment 10B. Like lower loop 150, hook 160 is a low-strength break-away device that is designed to yield and release the liner segment 10B from the eyelet 162 if an accident such as a grounding or collision occurs and pushes the liner segment 10B inward.

If desired, hook 160 can be a simple device, comparable to loops 150, or it can be a strong hook coupled to the reinforcing link or strand 166 by means of a coupling device which is designed to yield at a predetermined tension. Such devices include shear pins, snap fittings, thin cables, and other devices with limited tensile strength. During normal operation, these devices will hold the liner segments in place and evenly distribute the weight of each liner segment along the length of a stiffener, without subjecting any attachment point to excessive tensile forces. If desired, a stiff bar can be provided at any break-away corner, either inside liner segment 10B or on the interior side of the liner segment, so that the securing and/or lifting force provided by the breakaway attachment devices will be distributed evenly.

After hooks 160 are holding the upper region of the liner segment 10B in position beneath the underside of stiffener 106, the lower edge of the next liner segment 10C is placed in position on top of stiffener 106, and entire procedure is repeated, so that the upper end 114 of liner segment 10B and the lower edge 116 of liner segment 10C will both be clamped and held in position near the end of stiffener 106 by a set of attachment assemblies, each assembly including a bolt 170, bars 172 and 174, and a nut 176, which are assembled and tightened to provide watertight junctions in the same manner described previously.

FIG. 6 depicts liner segment 10B in a perspective view, showing the length of bar 130 and the multiple bolts 132 which are used to clamp down lower edge 110 of liner segment 10B. This figure also shows a vertical clamping bar 180 and bolts 182 which are used to form a watertight vertical seal between liner segment 10B and a transverse wall 200, which can be part of a transverse web or bulkhead. If desired, rectangular flaps such as side flap 184 can be provided in the liner segment to facilitate this operation; such flaps can be created by cutting rectangular sections out of a large rectangle of liner material (using bolt cutters to cut through any steel reinforcing links), or by creating liner segments having sideflap configurations during fabrication of the segments. Alternately, liners having pocketed shapes which will nestle into liner bays can be created during fabrication.

Water-tight (and oil-tight) joints such as corner seam 186 can be made between two segments of liner material by means such as rivets 188 (to provide strength), followed by a sealing compound such as silicone rubber or an oil-resistant caulk, or sealing by means of a heavy tape, to ensure that the seam is watertight (or nearly so). Corner joints between a liner segment and a metal wall, such as corner 190, can be sealed by injecting a sealant between the liner and the metal, if the joints are not adequately sealed by clamping bars such as bars 130 and 180.

One advantage of this type of installation is that it provides a water-tight, dry area between the outer hull 108 and the various liner segments installed between stiffeners, without occupying a substantial cargo-carrying volume. The entire cargo compartment (excepting only the volume actually occupied by the thickness of the liners) remains free for holding crude oil or refined products. This is in contrast to double-hulled tankers, and to flexible membrane systems in the prior art which propose to fill the space between the outer hull and the flexible membrane with seawater (which is heavy, bulky, and corrosive). By providing a watertight layer which seals off the hull, the liner system protects and prolongs the life of the hull, and there is no alteration in the standard tank-washing procedures that are normally carried out each time a VLCC is emptied of crude oil.

This system also provides a method of inspecting the hull, which must be done approximately every two years. By unclamping the upper end of any particular segment of the liner and unhooking the set of hooks (hook 160, in FIG. 5) which tuck that segment into the upper corner of the stiffener bay, the hull region which was covered by that particular segment of liner can be exposed for inspection. This can be done using normal inspection schedules, while a VLCC is returning (unloaded) to the oil fields to pick up more crude. Several tank compartments are usually inspected during each return trip, so that over the span of a year or two, every tank compartment in the VLCC is inspected.

If the side shell of the tanker is breached at the location of liner segment 10B by an intruding object during a collision or other accident, the liner segment 10B will pull away from the low-strength couplings 150 and 160 and can be pushed toward the interior of the tank compartment. After the accident is over and the intruding surface leaves, the liner segment will be pressed against the open breach in the hull by the pressure or motion of oil trying to escape from the tanker. Due to its strength and reinforcment, it will hold together as a cohesive layer across the hole in the tanker, thereby helping prevent or at least reduce the amount of oil spilled by the tanker.

The distance which a liner segment can be pushed away from the outer hull without damage will depend on several factors, including the shape of the intruding object, and the length of the stiffeners it is attached to. If two adjacent stiffeners are 0.5 meters long and have a distance of 1 meter between them, and if the liner segment is not pleated or otherwise provided with additional material, the liner segment could be pushed about 1 meter from the hull by a flat surface, and about 1.3 meters by a sharp object. However, this calculation assumes that the stiffeners will not yield at all, which is not a reasonable assumption in the event of a collision or grounding. If the outer hull is pushed in during an accident, the stiffeners attached to the hull at that location will also be pushed in by a corresponding amount, and the liner will be able to stay roughly 1 meter inboard when measured from the innermost edge of the stiffeners.

Figure 5:
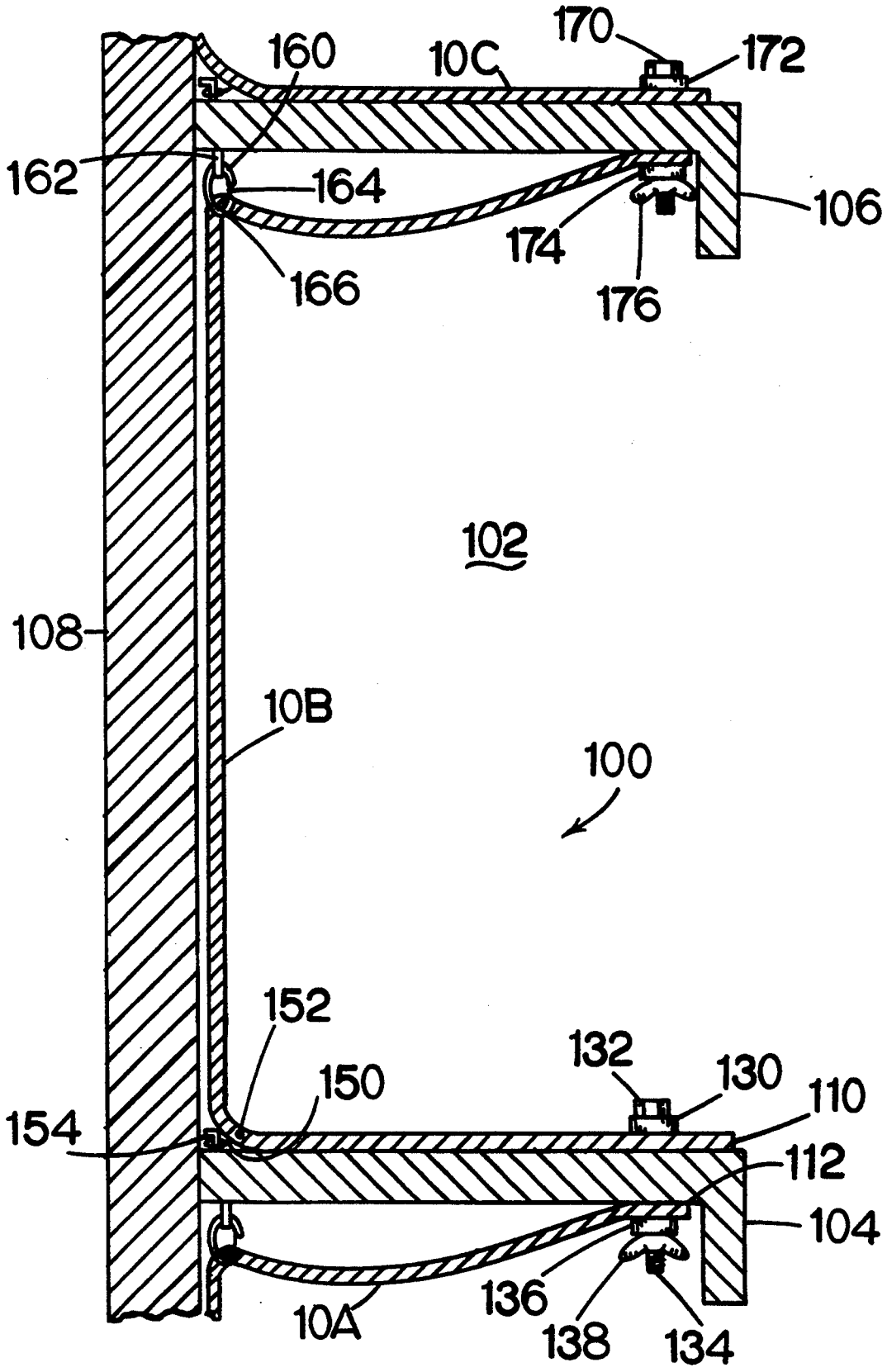
FIG. 5 is a cutaway side view (transverse section) showing a liner segment in a bay between two longitudinal stiffeners, using a detachable watertight clamp at the upper edge of the liner, a break-away coupling to prevent drooping, and a permanent attachment at the lower edge of the liner segment.
Figure 7:
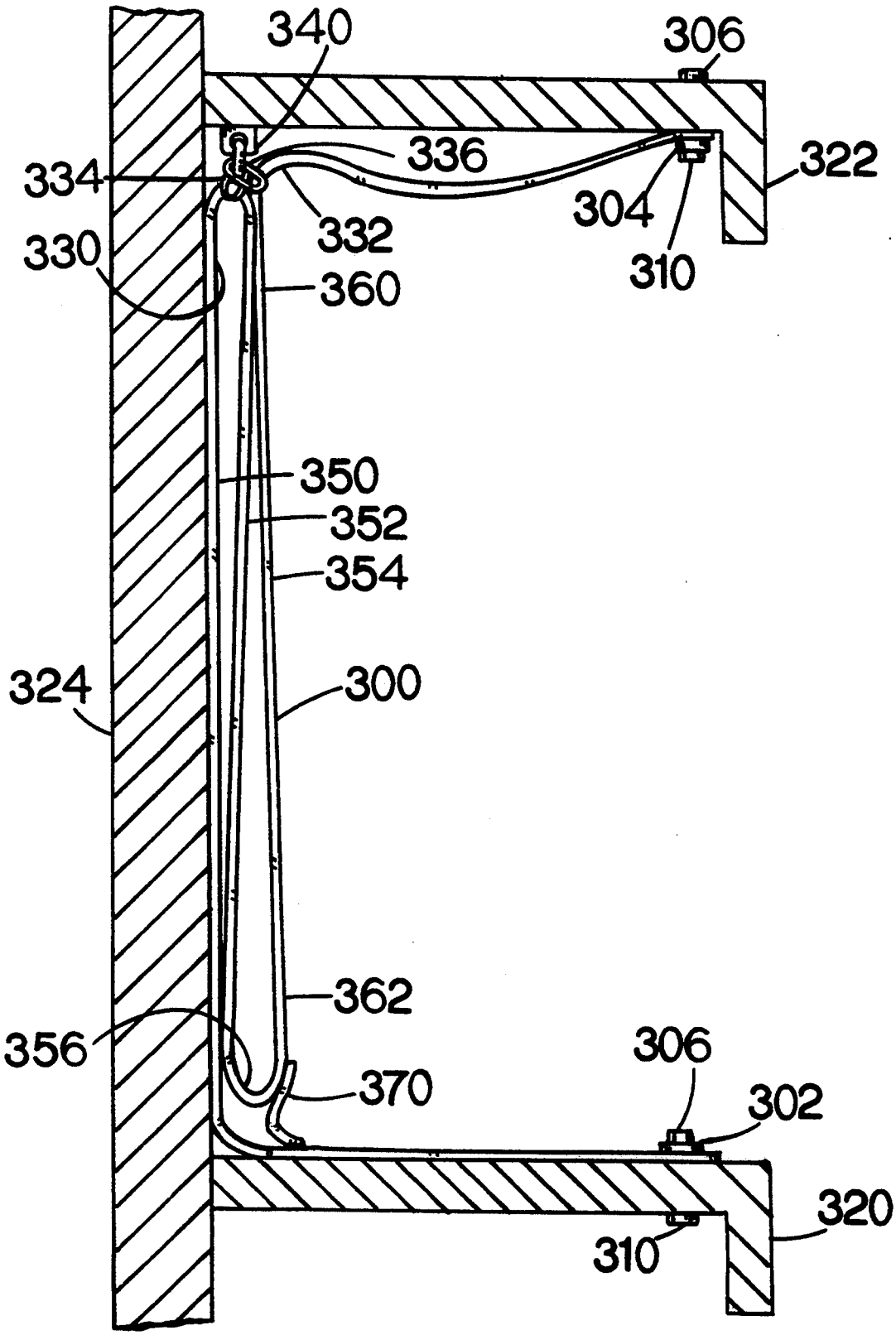
FIG. 7 is a cutaway side view (transverse section) of a liner segment in a bay between two longitudinal stiffeners, which has been pleated to provide additional material so that the liner can be pushed further inside the tank without cutting or tearing.

If desired, additional liner material can be provided by means such as a pleated or accordion arrangement as shown in FIG. 7. In this figure, liner segment 300 is installed in a stiffener bay in the same manner as described for liner segment 10B in FIG. 5, using clamping bars 302 and 304, bolts 306 and 308, and nuts 310 and 312 to create a watertight seal between liner 300 and stiffeners 320 and 322, which are welded to outer shell 324. However, two different pleats 330 and 332 are coupled via coupling devices 334 and 336 (which can be spring-gated hooks as shown in FIG. 5) to eyelet 340, which is welded to the underside of stiffener 322. This will create three layers of material 350, 352, and 354 spanning a portion (preferably most) of the distance between the stiffeners.

In FIG. 7, the hanging layers 350, 352, and 354 are shown as having space between them as they hang in a relaxed configuration. In actual operation, when the tank is loaded with oil, they will be pressed hard against each other, and there will be little or no empty space between them except at turns 330 and 356. To minimize the entrapment of air or other gases between the hanging layers, two rows of coupling devices can be driven through all three layers at approximately the heights indicated by callout numbers 360 and 362, during installation of the liner segment 300. Additionally or alternately, a segment of heavy tape 370 can be affixed at turn 356, to prevent any entry of oil into the gap between layers 350 and 352. This tape will yield if a serious accident occurs.

Various types of coupling devices are known which can penetrate and attach a coupling device to an elastomeric layer without causing a significant breach in the impermeability of the layer. As one example, a thin shaft of threaded plastic having an expandable head at the end (either an umbrella-type head which opens on a spring-loaded basis, or a torsion-activated type comparable to an anchoring screw used to mount heavy items on drywall in home construction) can be driven through all three layers, such as by forcing it through a hole which has been drilled through the layers. When the expandable head contacts the outer hull, it is opened to create an enlarged flat head next to the outer hull. A flat capping device is screwed onto the threaded plastic shaft and then tightened to form a tight seal, which will hold all three layers close together while the tank is being loaded or unloaded or during transit while empty. The threaded shaft will have a low tensile strength, since it will be designed to yield and release the folds if an accident occurs which breaches the hull and shoves the liner inward.

It should also be noted that any of the small metallic components described herein, including the clamping bars, bolts, nuts, and hooks, can be made of non-sparking metal such as brass or various other alloys, to minimize the possibility of creating sparks in flammable atmospheres.

The embodiments described above, which involve individual liner segments that can be installed into stiffener bays, can be installed, if desired, in all of the stiffener bays which are adjacent to the outer hull, on both the sides and the bottom of a tanker. Alternately, they can be installed only in the side bays if desired, such as in a double-bottom tanker, in a tanker which uses an enclosed bottom-bladder configuration such as described in Gallagher 1990 (summarized above), or in a tanker which uses a single-layer bottom liner in a "waterbed" configuration as described below.

The "Waterbed" Configuration (Bottom Stiffeners)

Figure 8:
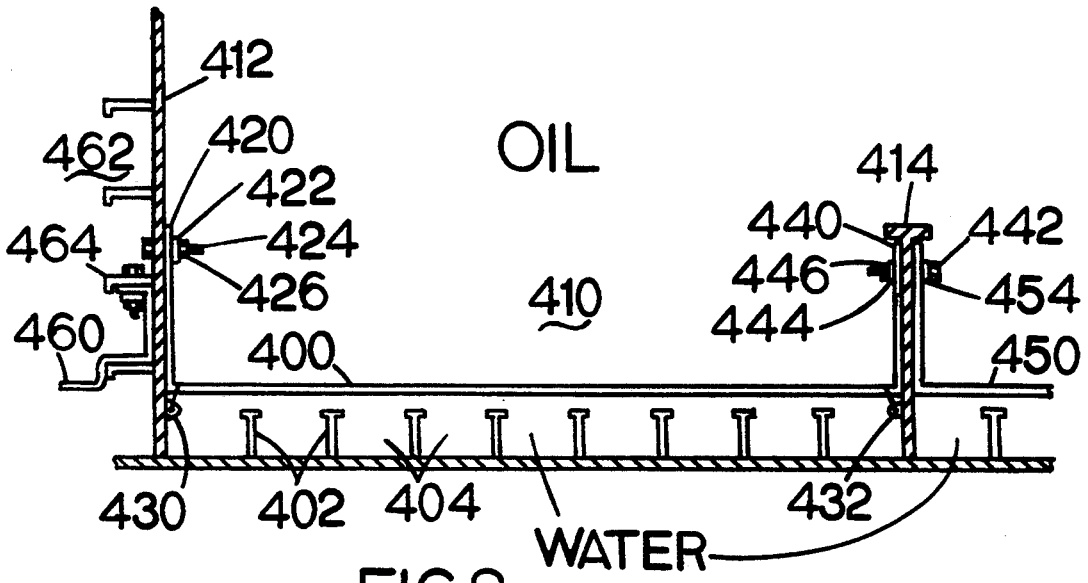
FIG. 8 is a cutaway side view (transverse section) showing a liner segment covering a number of bottom stiffeners and stiffener bays in a "waterbed" configuration.

FIG. 8 is a cutaway side view (longitudinal section) of flexible liner 400 which covers the bottom stiffeners 402 and stiffener bays 404 in a center tank 410. Liner segment 400 spans the area between a longitudinal bulkhead 412 and a longitudinal girder or web 414 (which may be positioned over the keel).

The outer side edge 420 of liner 400 is securely affixed to bulkhead 412 at a location which can provide a substantial amount of slack in the event of a grounding accident which pushes liner 400 into the interior of center tank 410. A water-tight attachment is made by means such as clamping bar 422, a row of bolts 424 which pass through small holes in bulkhead 412, and nuts 426. Alternately, to avoid the need to align components in the center tank with components in an outside (port or starboard) tank, bar 422 and nut 426 can be fastened to a threaded stud which can be welded to the interior surface of bulkhead 412, or they can be fastened using bolts and nuts which pass through holes in a small horizontal plate (comparable to a stiffener) which is available on, or which can be welded to, the interior surface of bulkhead 412.

If desired, breakaway devices 430 and 432 can be provided at the lower corners of liner 400, to make sure the liner stays properly positioned during loading and unloading operations.

The opposite (center) side edge 440 of liner 400 is attached to the keel girder/web 414 in a similar manner, using a row of bolts 442, clamping bar 444, and nuts 446, which are positioned a substantial distance above the tops of stiffeners 402 to provide slack in the event of a grounding accident.

A portion of a second center liner 450 is also shown, attached along a side edge 452 of the liner 450 to the other side of keel girder/web 414, using the same row of bolts 442 and a second clamping bar 454.

In addition, part of a third liner segment 460 is shown in an outside (port or starboard) tank 462. The side edge of liner 460 is attached to a longitudinal stiffener 464, using a bolt and clamping bar assembly. The opposite side edge (not shown) of outside tank liner 460 will be attached to a side stiffener (or to a bottom girder or web) above the tops of the bottom stiffeners.

In each of the tanks that are fitted with a bottom liner using this configuration, the bottom stiffener bays (such as bays 404 in center tank 410) are filled with liquid whenever the tank 410 contains oil. Water can be used, to minimize the amount of oil spilled in the event of an accident. Alternately, if the space between the bottom shell and the liner is filled with oil, that volume of oil presumably will be lost if an accident occurs, but such spills would be relatively small, and the liner will substantially reduce the risk of a massive spill and a resulting environmental catastrophe.

The water (or oil) which fills stiffener bays 402 provides a so-called "waterbed" support for liner 410, to prevent high shear or tearing stresses from being imposed on the liner by the weight of the oil. If sufficient water is provided to fill a volume which rises above the upper edges of stiffeners 402, as shown, liner 400 will float or rest on top of the water, with little or no touching or chafing between liner 400 and the top edges of stiffeners 402.

A bottom liner segment should leave the pump openings uncovered. Pump openings are positioned at or near the stern end of a tank, to take advantage of the fact that an empty tanker will rest in the water with the bow (front) higher than the stern (rear) of the ship, due to the weight of the engines, the bridge, and the crew quarters, which are located at or near the stern. This creates a drainage slope that helps pull the oil in a tank toward the pump openings in the stern end of the tank. This gravity-aided drainage is usually promoted by controlling the drainage sequence; drainage of the bow tanks begins first, and stern tanks are emptied last.

To take advantage of this standard design, a waterbed-type liner installation as described herein should cover most of the bottom of a tank, but it should leave the pump openings at the stern end of the tank uncovered.

The Curtain Configuration (Side Stiffeners)

Figure 9:
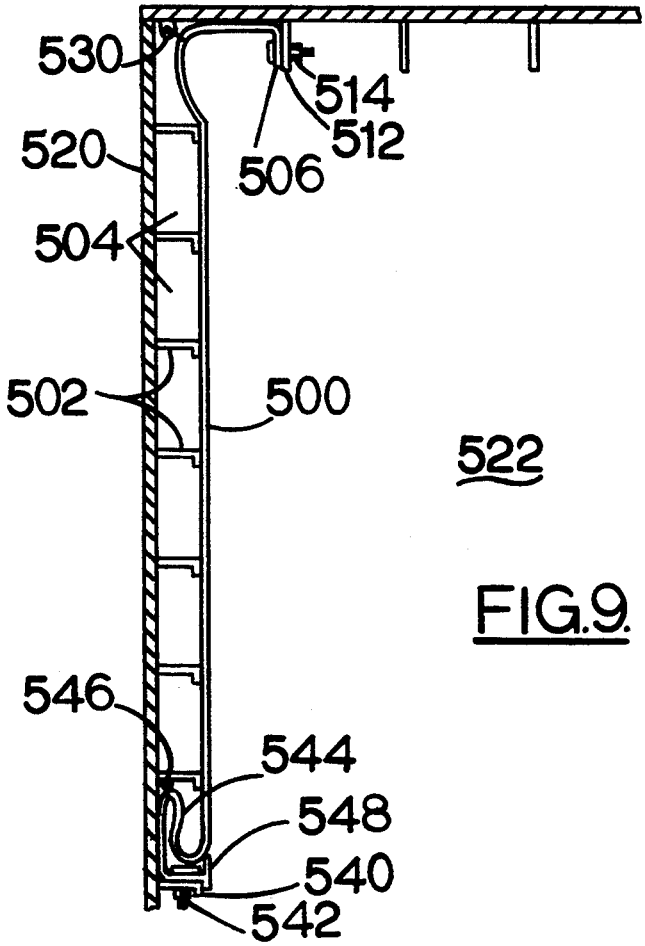
FIG. 9 is a cutaway side view (transverse section) showing a liner segment in a "curtain" configuration, covering a number of side stiffeners and stiffener bays.

A curtain-type liner 500 which covers a number of side stiffener 502 and side stiffener bays 504 is shown in FIG. 9. The upper edge 506 of liner segment 500 is affixed to the underside of deck structure 510, using a watertight attachment. For example, liner 500 can be attached to a deck stiffener 512 by means of clamping bar assembly 514. The attachment is made a sufficient distance from side shell 520 to allow the liner 500 to be pushed a substantial distance into the tank 522 if an accident occurs; alternately, the attachment can be made at or near the side shell, if a fold of material is provided as shown in FIG. 7 or as described below.

If desired, a row of break-away attachment devices 530 can be provided near an upper corner of liner 500.

Side girders are not used in most tankers; accordingly, to avoid the requirement of retrofitting a side girder into a tanker, an alternate means of attaching the lower edge of side curtain, while providing sufficient slack to allow the liner 500 to be pushed a large distance into the tank 522, is shown in FIG. 9. This involves coupling the bottom edge of liner 500 to a side stiffener 540, using a watertight attachment such as clamping bar assembly 542, and providing an extra fold of material 544 which is held in a stiffener bay by means of a breakaway attachment device 546. The extra fold 544 can be sealed off by heavy tape 548.

In order to avoid high shear, abrasion, and tearing forces from being imposed on liner 500 at the locations where it is pressed against side stiffeners 502, stiffener bays 504 should be filled with a liquid (either water or oil can be used, as described above for the waterbed configuration). The filling operation should be done in a coordinated manner while the tank 522 is being filled with oil, so that the liquid levels of the oil and water are at roughly the same height during the filling operation, with the water level dropping to a somewhat lower level as the filling operation nears completion, due to the higher density of water. This will prevent bulging or sagging of liner 500 during the filling operation. In effect, liner 500 will float in a suspended manner in the oil, occasionally touching or pressed lightly against the ends of stiffeners 502; however, liner 500 will not be pushed hard against stiffeners 502, since the hydrostatic pressure of the water in the stiffener bays 504 will balance out the pressure of the oil against the liner 500.

This type of coordinated filling operation, wherein the stiffeners bays 504 are filled with water simultaneously with the oil being loaded into tank 522, will require an additional piping system (which includes sensors and controls to ensure that the pressure on both sides remains roughly in balance during the entire filling operation). In addition, this system would require the interior surface of the side shell 520 to be painted or coated with a layer of impermeable material to prevent the water from reaching it and causing corrosion. Due to the added expense and operating requirements for this additional piping and control system and hull coating, this embodiment is not believed to be optimal. However, it is recognized as a feasible system which can be implemented and used despite the added expense, if desired, and it has one potentially important advantage: in at least some types of installations, a large liner curtain which covers multiple stiffener bays can be pushed a substantially greater distance into a tank compartment than a relatively small liner which occupies only one stiffener bay.

This side-curtain liner configuration can be released for inspection, repair, or replacement, by unbolting the clamping bars at the lower edge (and, if desired, the upper edge as well) and temporarily pulling the curtain away from the outer shell. If desired, pulleys which are lowered through deck hatches can be used to hold the weight of the lower half of the curtain during inspection or repair. This would allow one or two men working in slings or bosun chairs to enter the tank, uncouple the lower edge of a curtain segment, inspect the outer shell, and reattach the lower edge of the curtain, with assistance from outside the tank.

Thus, there has been shown and described a new and useful means for providing flexible liner segments to reduce the amount of oil spilled by oil tankers and other vessels in the event of accidents such as groundings or collisions. Although these liner segments have been illustrated and described by reference to various specific examples, it will be apparent to those skilled in the art that various modifications and alterations of these examples are possible without departing from the spirit and scope of this invention. Any such variants and equivalents which derive directly from the teachings herein are deemed to be covered by this invention.

We claim:

1. A backup containment structure in a floating tank vessel having a cargo tank adjacent to an outer hull, wherein the cargo tank contains longitudinal stiffener members which are affixed to and which project inwardly from an internal surface of the outer hull, comprising a flexible liner segment installed in a stiffener bay between longitudinal stiffener members, wherein the liner segment is directly coupled in a watertight manner to said longitudinal stiffener members to provide a watertight region between the liner segment and the outer hull wherein the liner segment can be pushed a substantial distance into the cargo tank without breach of the liner segment if the outer hull is breached, and wherein the liner segment is directly coupled to at least one longitudinal stiffener member by means of a detachable watertight attachment device which allows at least one edge of the liner segment to be temporarily detached from said stiffener member to allow periodic visual inspection of the interior surface of the outer hull in a region covered by the liner segment.

2. The backup containment structure of claim 1 wherein at least one detachable attachment device comprises a removable clamping bar which is secured in position and pressed against a surface of the liner segment by mechanical tightening means.

3. The backup containment structure of claim 1 wherein a portion of the liner segment is secured in position during normal operation by a plurality of yielding attachment devices which have low tensile strength and which are designed to yield and release the liner segment if an intruding object breaches the outer hull and pushes the liner segment inward with a force that exceeds the tensile strength of the yielding attachment devices.

4. The backup containment structure of claim 1 wherein the liner segment is reinforced by a material selected from the group consisting of steel mesh, woven aramid fibers, woven polyester fibers, and woven nylon fibers.

5. A backup containment structure in a floating tank vessel having a cargo tank adjacent to a bottom shell portion of an outer hull, wherein the cargo tank contains bottom longitudinal stiffener members affixed to and projecting upwardly from the bottom shell portion, wherein the bottom longitudinal stiffener members are positioned between a longitudinal bulkhead and a girder member which projects inwardly from an internal surface of the cargo tank, both of which are taller than the bottom longitudinal stiffener members, comprising a flexible liner segment which covers a plurality of said bottom stiffener members and stiffener bays flanked by said bottom stiffener members, wherein:

a. the liner segment is affixed along opposed side edges directly to the longitudinal bulkhead and the girder member by means of watertight junctions in a manner which provides a watertight region between said liner segment and the bottom shell portion of the outer hull and which allows said liner segment to be pushed a substantial distance into the cargo tank without breach of the liner segment if the bottom shell portion of the outer hull beneath said liner segment is breached;

b. the watertight region between the liner segment and the outer hull is filled with liquid when the cargo tank is filled with oil, to minimize abrasion and tearing forces on the liner segment due to hydrostatic pressure from the oil; and, c. the liner segment is directly affixed to at least one of said longitudinal bulkhead or girder member components in said cargo tank by means of a detachable attachment device which allows at least one edge of the liner segment to be temporarily detached from said longitudinal bulkhead or girder member to allow periodic visual inspection of the interior surface of the outer hull in a region covered by the liner segment.

6. The backup containment structure of claim 5 wherein at least one detachable attachment device comprises a removable clamping bar which is secured in position and pressed against a surface of the liner segment by mechanical tightening means.

7. The backup containment structure of claim 5 wherein a portion of the liner segment is secured in position during normal operation by a plurality of yielding attachment devices which have low tensile strength and which are designed to yield and release the liner segment if an intruding object breaches the outer hull and pushes the liner segment inward with a force that exceeds the tensile strength of the yielding attachment devices.

8. The backup containment structure of claim 5 wherein the liner segment is reinforced by a material selected from the group consisting of steel, woven aramid fibers, woven polyester fibers, and woven nylon fibers.

* * * * *